US006771157B2

(12) United States Patent
Nishikawa et al.

(10) Patent No.: US 6,771,157 B2
(45) Date of Patent: Aug. 3, 2004

(54) WIRE-WOUND COIL

(75) Inventors: Yoshie Nishikawa, Fukui (JP); Kiyoteru Igashira, Takefu (JP); Takaaki Ooi, Takefu (JP)

(73) Assignee: Murata Manufacturing Co., LTD, Kyoto (JP)

( * ) Notice: Subject to any disclaimer, the term of this patent is extended or adjusted under 35 U.S.C. 154(b) by 0 days.

(21) Appl. No.: 10/270,695

(22) Filed: Oct. 16, 2002

(65) Prior Publication Data

US 2003/0080844 A1 May 1, 2003

(30) Foreign Application Priority Data

Oct. 19, 2001 (JP) ..... 2001-322664
Nov. 21, 2001 (JP) ..... 2001-356552
Jun. 5, 2002 (JP) ..... 2002-164799

(51) Int. Cl.[7] ..... H01F 17/06
(52) U.S. Cl. ..... 336/178; 336/212
(58) Field of Search ..... 336/65, 83, 178, 336/198, 200, 206–208, 220–221, 212, 232

(56) References Cited

U.S. PATENT DOCUMENTS 6,201,463 B1 * 3/2001 Yamashita et al. ..... 336/198
6,600,402 B1 * 7/2003 LaFleur et al. ..... 336/61

* cited by examiner

*Primary Examiner*—Tuyen T. Nguyen
(74) *Attorney, Agent, or Firm*—Keating & Bennett, LLP

(57) ABSTRACT

A wire wound core has windings which are wound in a single-layer winding fashion around substantially cylindrical body portions of bobbins. A gap is provided between the inner wall of a hole formed in the substantially cylindrical body portion of each bobbin and the outer peripheral surface of a leg portion of a corresponding core member by a rail-shaped rib disposed on the inner wall of the hole. Another gap is provided between the inner surface of an arm portion of the core member and the outer major of a flange portion of the bobbin by a convex spacer disposed on the outer major surface of the core member.

21 Claims, 20 Drawing Sheets

WIRE-WOUND COIL

BACKGROUND OF THE INVENTION

1. Field of the Invention

The present invention relates to a wire-wound coil, and more particularly, to a wire-wound coil for use in, for example, an inductor, a common-mode choke coil, a normal-mode choke coil, a transformer, or other suitable device.

2. Description of the Related Art

In general, the insertion loss versus frequency characteristic of a common-mode choke coil is significantly influenced by an inductance component due to the common-mode inductance L in the region of frequencies lower than the self-resonant frequency, and is significantly influenced by a capacitance component due to the stray capacitance C produced in the common-mode choke coil in the region of frequencies higher than the self-resonant frequency. The self-resonant frequency measured when the impedance is about 50 Ω is represented by the following Expression f0, the insertion loss versus frequency characteristic in the region of frequencies lower than the self-resonant frequency is represented by the following Approximate Expression 1, and the insertion loss versus frequency characteristic in the region of frequencies higher than the self-resonant frequency is represented by the following Approximate Expression 2:

$$f0:fr=1/[2\pi(LC)^{1/2}]$$

Approximate Equation 1:

$$\text{insertion loss}=10\log[1+(\omega L/100)^2]$$

Approximate Equation 2:

$$\text{insertion loss}=10\log[1+1/(100\omega C)^2]$$

In order to improve the noise-eliminating performance of the common-mode choke coil in the high-frequency region, the stray capacitance C must be decreased. The stray capacitance C is principally caused by the influences of a winding structure of windings, bobbins, and a magnetic core. In order to reduce the influence of the bobbins, it is necessary to change the material of the bobbins to a material having a lower dielectric constant, or to reduce the thickness of the bobbins. However, when the common-mode choke coil is used for an AC supply line, flame retardancy, relative thermal index, an insulation distance according to the safety standards must be ensured. Since existing common-mode choke coils generally adopt thick bobbins having a thickness of 0.5 mm to 1.0 mm and are made of a material having a dielectric constant ∈ of 2 to 4, it is difficult to reduce the influence of the bobbins on the stray capacitance C by changing the material and thickness of the bobbins.

Accordingly, in order to reduce the stray capacitance C produced in the common-mode choke coil, it is important to reduce the influence of the winding structure of the windings, and the influence of the magnetic core. The ratio of the influences varies depending on the winding structure of the windings. For example, so-called sectional winding for winding windings in sections is known as a winding structure that produces little stray capacitance.

FIG. 21 shows the configuration of a known common-mode choke coil 1 in which windings 7 and 17 are wound in sections. The common-mode choke coil 1 includes a magnetic core constituted by two U-shaped core members 20 and 21, and two bobbins 2 and 12. The bobbins 2 and 12 include cylindrical body portions 3 and 13, and flange portions 4, 5, and 6, and 14, 15, and 16 provided in the cylindrical body portions 3 and 13, respectively.

The winding 7 is formed by electrically connecting a first winding portion 7*a* and a second winding portion 7*b* in series. The first winding portion 7*a* is wound between the flange portions 4 and 6 of the bobbin 2, and the second winding portion 7*b* is wound between the flange portions 5 and 6. Similarly, the winding 17 is formed by electrically connecting a first winding portion 17*a* and a second winding portion 17*b* in series. The first winding portion 17*a* is wound between the flange portions 14 and 16 of the bobbin 12, and the second winding portion 17*b* is wound between the flange portions 15 and 16.

The bobbins 2 and 12 are arranged so that the cylindrical body portions 3 and 13 thereof are parallel to each other. Leg portions 20*b* and 21*b* of the core members 20 and 21 extend in holes 3*a* and 13*a* of the cylindrical body portions 3 and 13, respectively. The core members 20 and 21 define one closed magnetic circuit with the leading end surfaces of the leg portions 20*b* and 21 abutting against each other inside the holes 3*a* and 13*a*.

In the common-mode choke coil 1 having the above-described configuration, since the stray capacitance is substantially proportional to the winding width, when the windings 7 and 17 are divided into the two winding portions 7*a* and 7*b* and the two winding portions 17*a* and 17*b*, respectively, the stray capacitance of one winding portion is half the stray capacitance of the undivided winding.

Since the winding portions 7*a* and 7*b*, or the winding portions 17 and 17*b* are connected in series, the stray capacitance of each of the windings 7 and 17 in the two-section winding common-mode choke coil 1 is one fourth of the stray capacitance of the undivided winding (for example, approximately 4.0 pF).

Another winding structure is a so-called single-layer winding structure in which a winding is wound only in one layer. In this winding structure, the turns are adjacent only in the lateral direction, and a number of stray capacitances produced in the adjacent turns corresponding to the number of turns are connected in series, which can minimize the stray capacitance. For example, the stray capacitance (4.0 pF) in the above-described sectional winding can be reduced to approximately one-sixth or less by the single-layer winding. However, the inductance obtained in this case is low.

A so-called single-layer multiple winding structure is also known in which a plurality of single-layer windings are stacked in parallel. In order to overcome the problem of low inductance in the single-layer winding structure, in this winding structure, the diameter of the wire is decreased, and the number of turns in each layer of the winding is increased, thereby increasing the inductance. Since the direct resistance of the windings is thereby increased, a plurality of stacked layers of windings are connected in parallel. That is, the single-layer multiple winding structure has characteristics similar to those of the single-layer winding structure, and also achieves a relatively high inductance. However, the stray capacitance is higher than in the single-layer winding structure.

Table 1 shows the general differences of the stray capacitance, the direct resistance of the winding, and the inductance among the above-described winding structures when the wire diameter is not changed.

TABLE 1

| | |
|---|---|
| Stray Capacitance | Single-layer < Single-layer Multiple < Sectional |
| Direct Resistance | Single-layer Multiple < Single-layer < Sectional |
| Inductance | Single-layer = Single-layer Multiple < Sectional |

In general, the areas in which the windings 7 and 17 of the common-mode choke coil 1 can be wound are limited by, for example, the planar area of the space defined by the inner peripheries of the core members 20 and 21 that define the closed magnetic circuit, the thickness of the bobbins 2 and 12, and the insulation distance. The known common-mode choke coil 1 is designed so that there is no wasted space, in order to achieve the maximum possible inductance in the limited winding areas. Therefore, only the minimum gaps required for assembly operation and safety standards are formed between the core members 20 and 21 and the bobbins 2 and 12, or between the core members 20 and 21 and the windings 7 and 17. Consequently, the stray capacitance produced by the core members 20 and 21 is relatively high. In the common-mode choke coil 1 in which the windings 7 and 17 are wound in a manner that produces less stray capacitance than the multiple winding common-mode choke coil which does not have the center flange portions 6 and 16 for dividing the windings 7 and 17, the influence of the stray capacitance is not negligible. In particular, in the single-layer winding structure and the single-layer multiple winding structure that produce little stray capacitance, the influence of the core members 20 and 21 on the stray capacitance is quite significant.

SUMMARY OF THE INVENTION

In order to overcome the problems described above, preferred embodiments of the present invention provide a wire-wound coil having a structure that minimizes the influence of a magnetic core on the stray capacitance.

According to a preferred embodiment of the present invention, a wire-wound coil includes one or more bobbins each having a substantially cylindrical body portion and a flange portion disposed on the substantially cylindrical body portion, one of a single-layer winding and a single-layer multiple winding wound on the substantially cylindrical body portion of each of the bobbins, and a magnetic core having an arm portion and a leg portion extending in a hole formed in the substantially cylindrical body portion of each of the bobbins so as to define a closed magnetic circuit, wherein a first gap is formed between the inner peripheral surface of the hole of the substantially cylindrical body portion of each of the bobbins and the outer peripheral surface of the leg portion of the magnetic core, and a second gap is formed between the flange portion of each of the bobbins and the arm portion of the magnetic core facing the flange portion.

The first gap is formed, for example, by a rail-shaped rib disposed on at least one of the inner peripheral surface of the hole of the substantially cylindrical body portion of each of the bobbins and the outer peripheral surface of the leg portion of the magnetic core. The second gap is formed, for example, by a convex spacer disposed on at least one of the flange portion and the leg portion of the magnetic core facing the flange portion. Preferably, the first gap is about 0.3 mm to about 1.5 mm, and the second gap is about 0.7 mm to about 4.0 mm.

With the unique configuration as described above, the gaps of predetermined lengths are ensured between the magnetic core and the winding, and the distance therebetween is increased. This reduces the influence of the magnetic core on the stray capacitance. As a result, it is possible to achieve a wire-wound coil having superior electrical characteristics in the high-frequency region.

By placing an insulating resin member including magnetic powder or a ferrite member covered with insulating resin between two adjoining bobbins, the effective magnetic permeability of the normal-mode magnetic circuit is increased, and the normal-mode inductance is increased. Moreover, since magnetic flux is concentrated by the insulating member including magnetic powder or the ferrite member covered with insulating resin, magnetic flux does not leak to the outside.

Further elements, characteristics, features, and advantages of the present invention will become apparent from the following description of preferred embodiments with reference to the attached drawings.

DETAILED DESCRIPTION OF PREFERRED EMBODIMENTS

Figure 1:
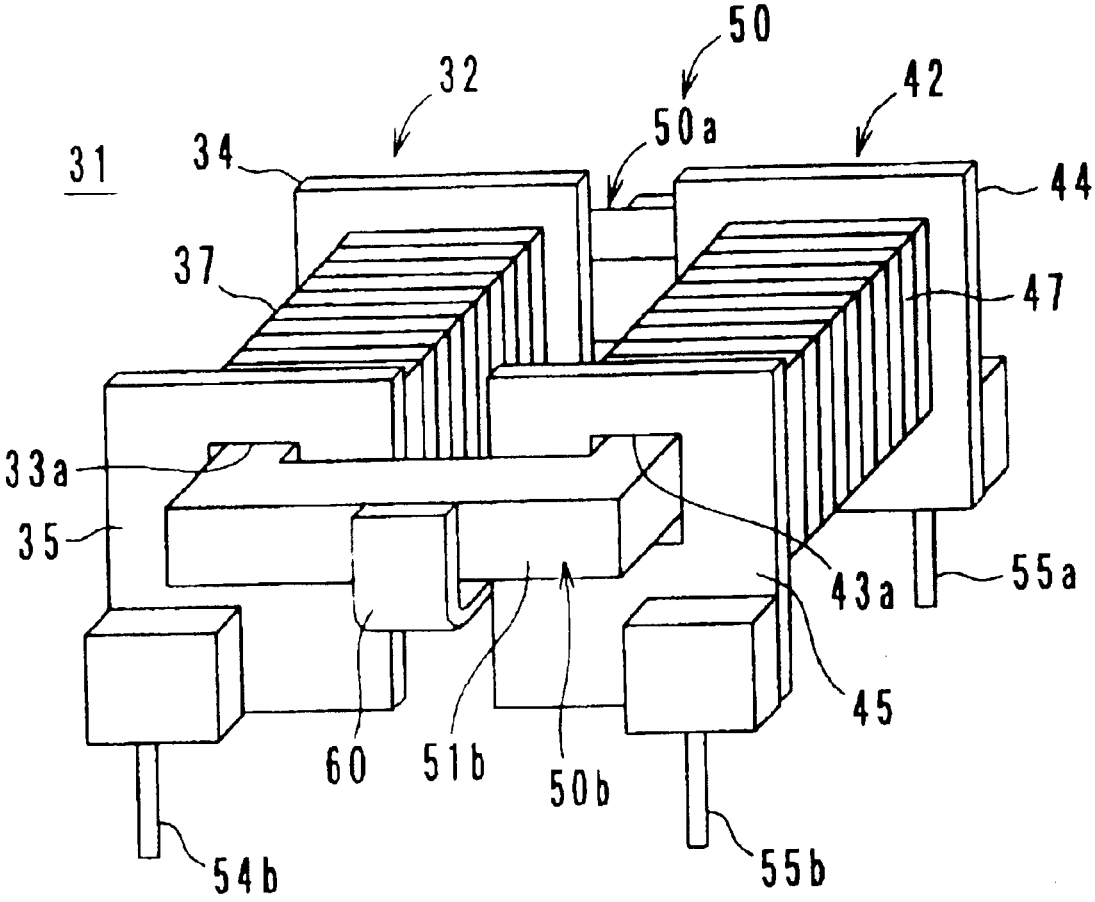
FIG. 1 is an external perspective view of a wire-wound coil according to a preferred embodiment of the present invention.

A wire-wound coil according to a preferred embodiment of the present invention will be described below with reference to the attached drawings. In this preferred embodiment, a common-mode choke coil will be described as an example of the wire-wound coil.

FIGS. 1, 2, 3, 4, and 5 are an external view, a front view, a horizontal sectional view, a partial vertical sectional view, and an electrical equivalent circuit diagram, respectively, of a common-mode choke coil 31. The common-mode choke coil 31 preferably includes a magnetic core 50 constituted by two substantially U-shaped core members 50*a* and 50*b*, two bobbins 32 and 42, and a fastening member 60.

The bobbins 32 and 42 include substantially cylindrical body portions 33 and 43, and flange portions 34 and 35 and flange portions 44 and 45 disposed at both ends of the substantially cylindrical body portions 33 and 43, respectively. Lead terminals 54*a*, 54*b*, 55*a*, and 55*b* are embedded in the flange portions 34, 35, 44, and 45. The bobbins 32 and 42 are arranged with the substantially cylindrical body portions 33 and 43 disposed substantially parallel with each other, and are made of, for example, resin.

Windings 37 and 44 are wound around the substantially cylindrical body portions 33 and 43 of the bobbins 32 and 42 in a single-layer winding fashion, and have the same number of turns. Both ends of the winding 37 are electrically connected to the lead terminals 54*a* and 54*b* of the bobbin 32, respectively. Similarly, both ends of the winding 47 are electrically connected to the lead terminals 55*a* and 55*b* of the bobbin 42.

The core members 50*a* and 50*b* that constitute the magnetic core 50 include arm portions 51*a* and 51*b*, and leg portions 52*a* and 52*b* extending substantially perpendicularly from both ends of the arm portions 51*a* and 51*b*, respectively. The leg portions 52*a* and 52*b*, which are substantially rectangular in transverse-cross section, of the core members 50*a* and 50*b* extend in holes 33*a* and 43*a*, which are substantially rectangular in transverse cross-section, disposed in the substantially cylindrical body portions 33 and 43 of the bobbins 32 and 42. The core members 50*a* and 50*b* define a closed magnetic circuit with the leading end surfaces of the leg portions 52*a* and 52*b* abutting against each other inside the holes 33*a* and 43*a*.

Figure 2:
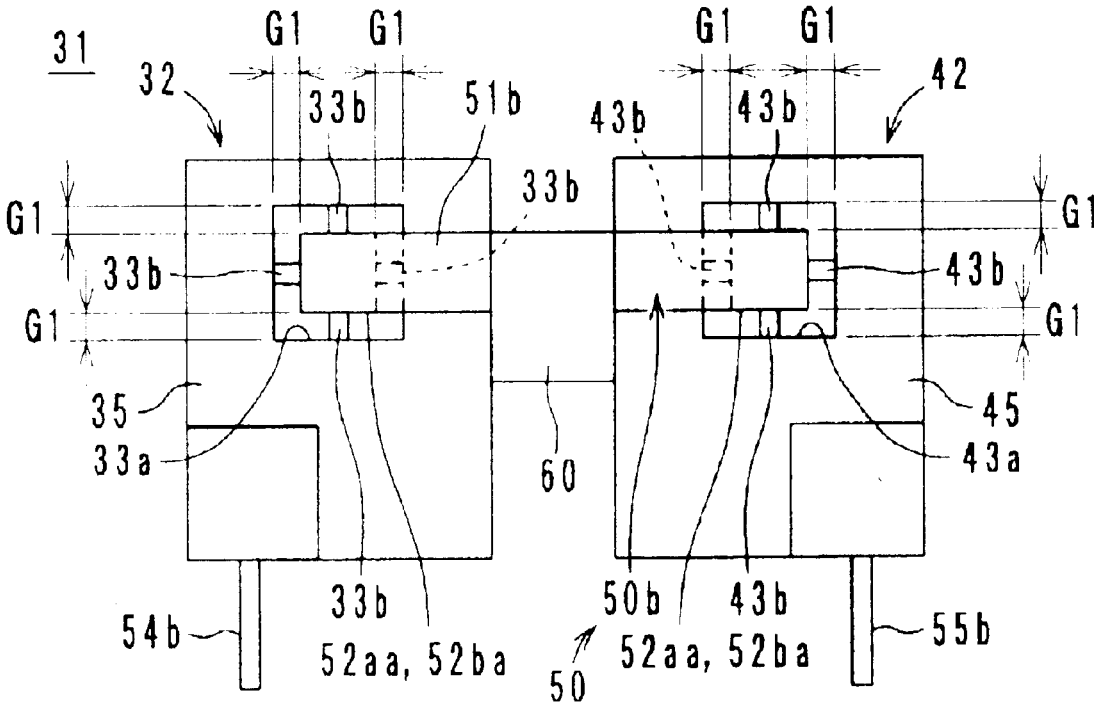
FIG. 2 is a front view of the wire-wound coil shown in FIG. 1.
Figure 3:
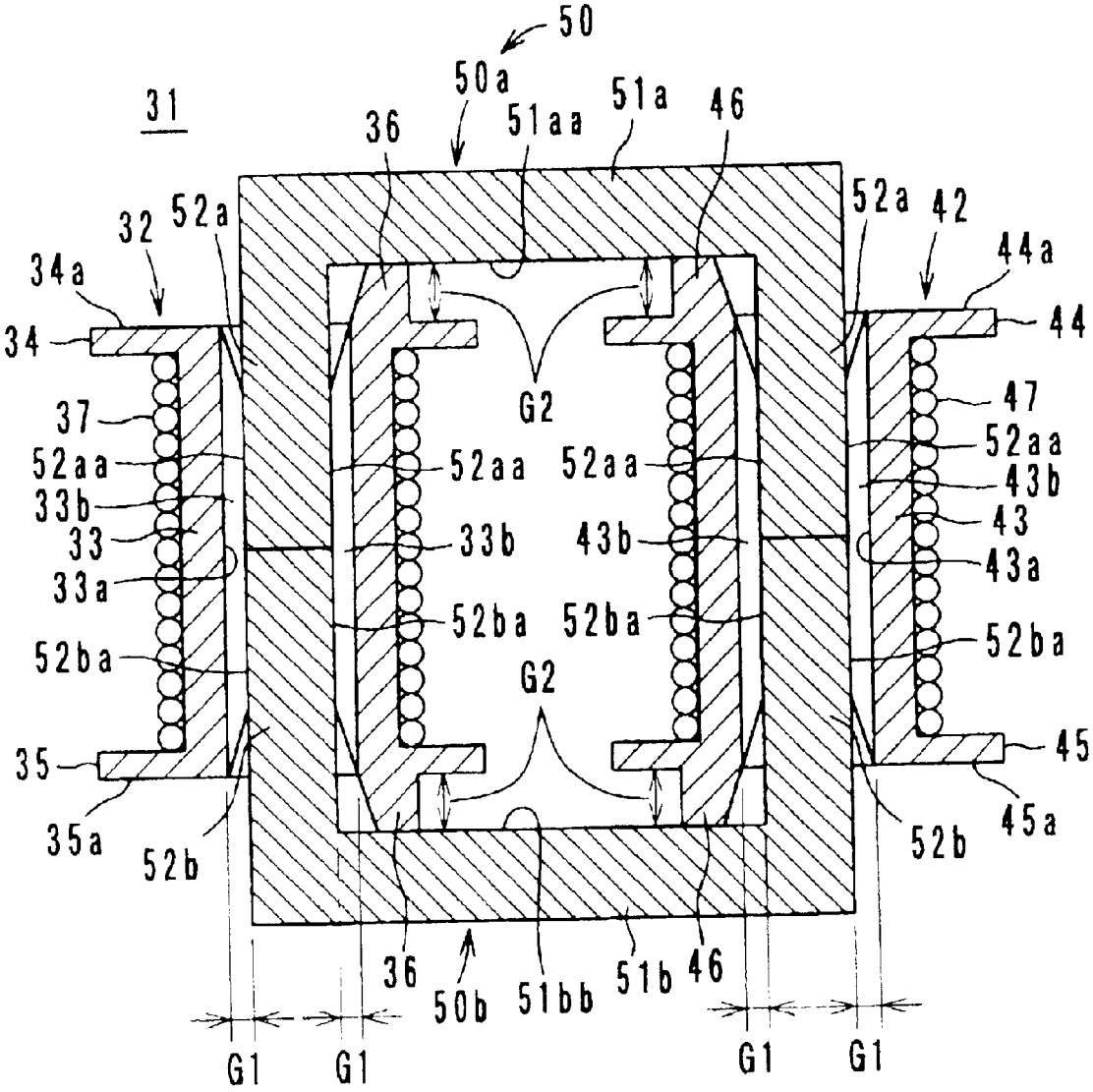
FIG. 3 is a horizontal sectional view of the wire-wound coil shown in FIG. 1.
Figure 4:
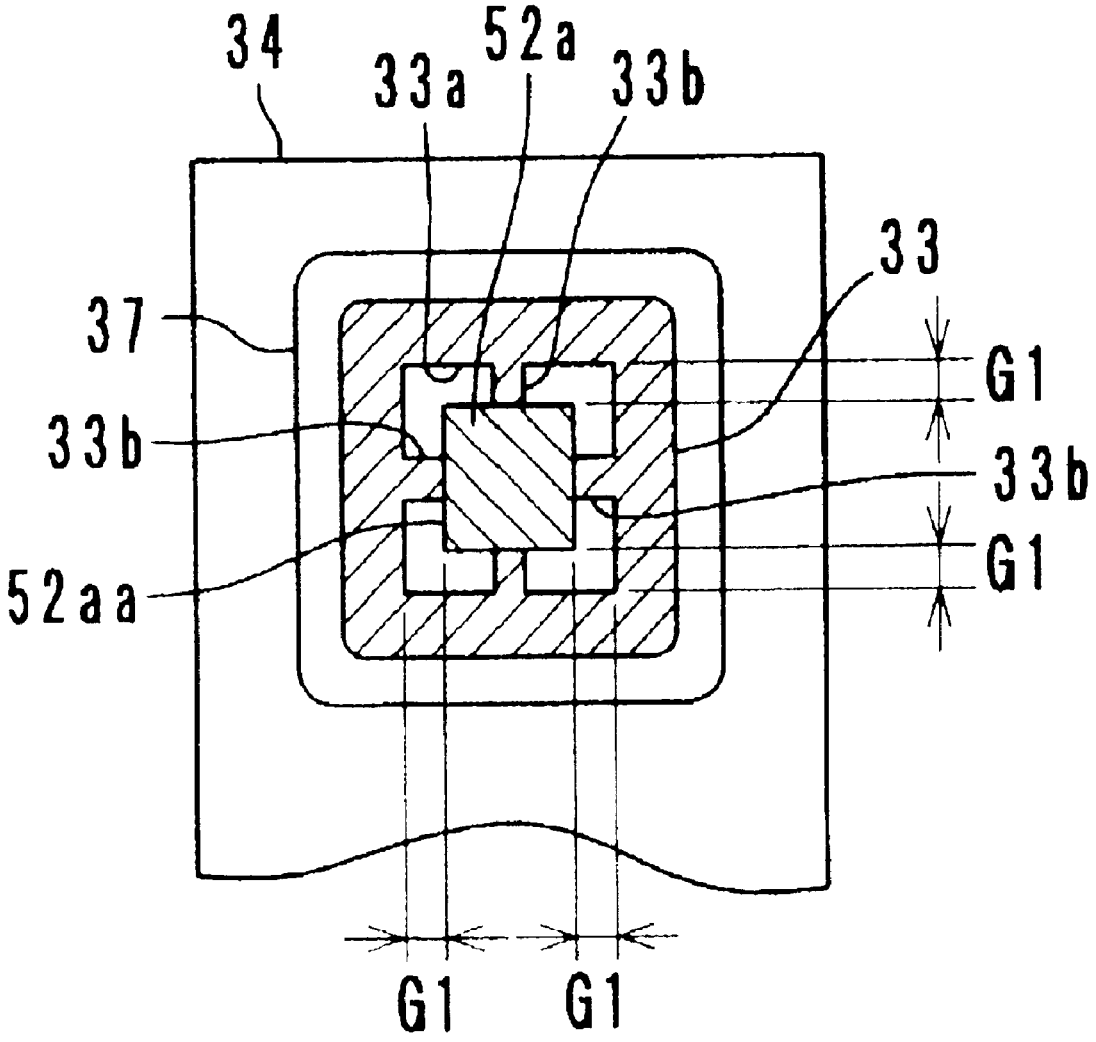
FIG. 4 is a partial vertical sectional view of the wire-wound coil shown in FIG. 1.
Figure 5:
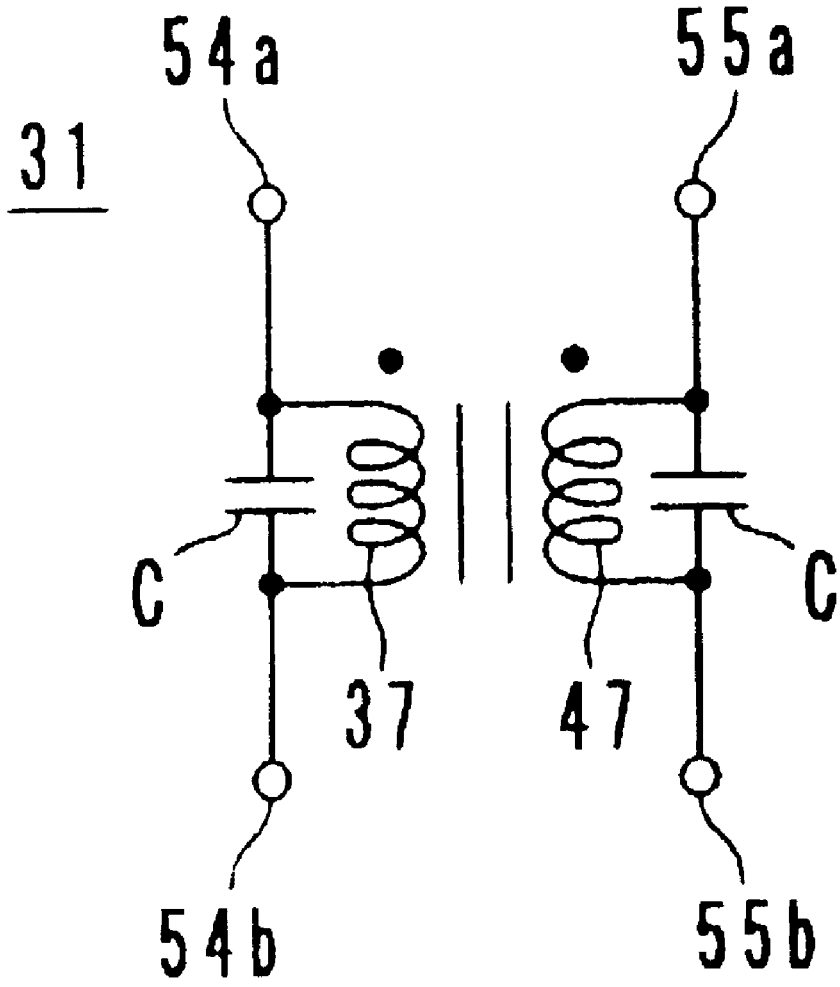
FIG. 5 is an electrical equivalent circuit diagram of the wire-wound coil shown in FIG. 1.

As shown in FIGS. 2 to 4, rail-shaped ribs 33*b* and 43*b* are disposed on four inner walls of the holes 33*a* and 43*a* of the substantially cylindrical body portions 33 and 43 of the bobbins 32 and 42 so as to form gaps. Both ends of the rail-shaped ribs 33*b* and 43*b* are tapered so that the leg portions 52*a* and 52*b* of the core members 50*a* and 50*b* can be easily inserted. The rail-shaped ribs 33*b* and 43*b* define gaps G1 between outer peripheral surfaces 52*aa* and 52*ba* of the leg portions 52*a* and 52*b* of the core members 50*a* and 50*b*, and the inner walls of the holes 33*a* and 43*a*. It is preferable that the contact surfaces between the rail-shaped ribs 33*b* and 43*b* and the core members 50*a* and 50*b* be flat in order to reliably hold the core members 50*a* and 50*b*, and that the contact areas therebetween be small in order to minimize the stray capacitance. Therefore, for example, the contact surfaces are preferably round surfaces. While it is preferable that the gaps G in the horizontal direction and the gaps G in the vertical direction be substantially equal to each other as in this preferred embodiment, of course, they may be different.

As shown in FIG. 3, the arm portions 51*a* and 51*b* of the core members 50*a* and 50*b* face the flange portions 34, 35, 44, and 45 of the bobbins 32 and 42. Outer major surfaces 34*a*, 35*a*, 44*a*, and 45*a* of the flange portions 34, 35, 44, and 45 are provided with convex spacers 36 and 46 for forming gaps. The convex spacers 36 and 46 are tapered so that the leg portions 52*a* and 52*b* of the core members 50*a* and 50*b* can be easily inserted into the holes 33*a* and 43*a*. Gaps G2 of a predetermined length are disposed between inner side surfaces 51*aa* and 51*bb* of the arm portions 51*a* and 51*b* and the outer major surfaces 34*a*, 35*a*, 44*a*, and 45*a* of the flange portions 34, 35, 44, and 45.

Figure 6:
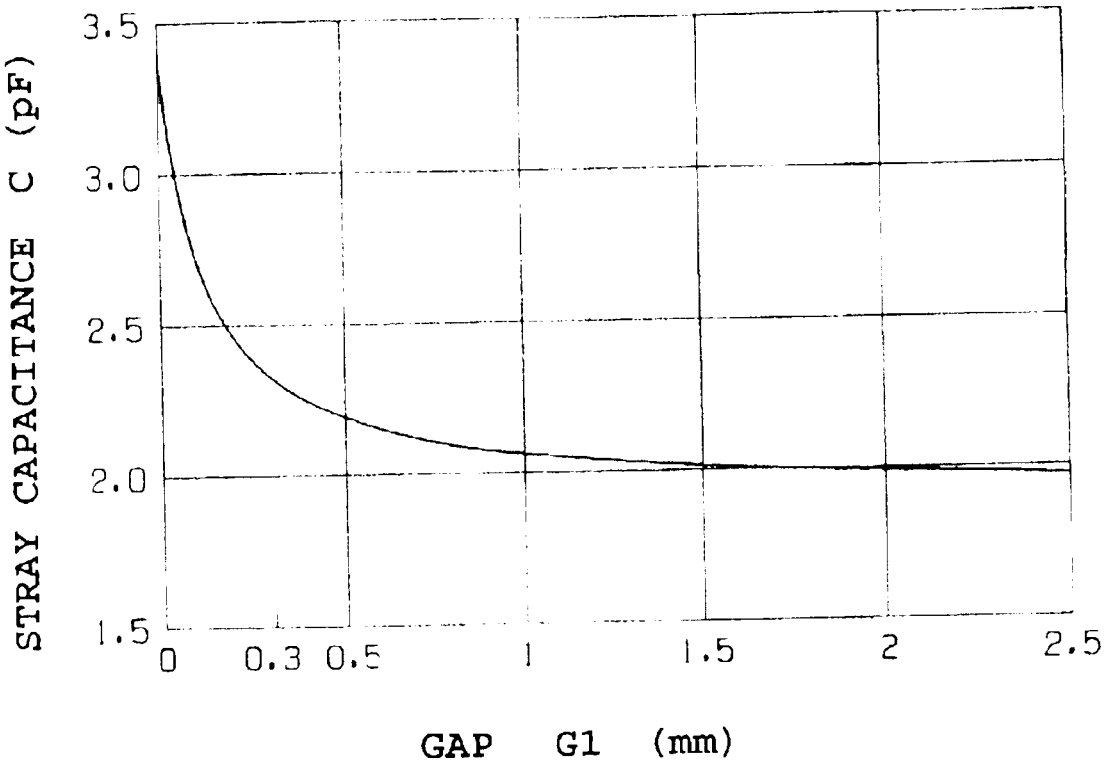
FIG. 6 is a graph showing the relationship between the gap G1 of the wire-wound coil shown in FIG. 1 and the stray capacitance C.
Figure 7:
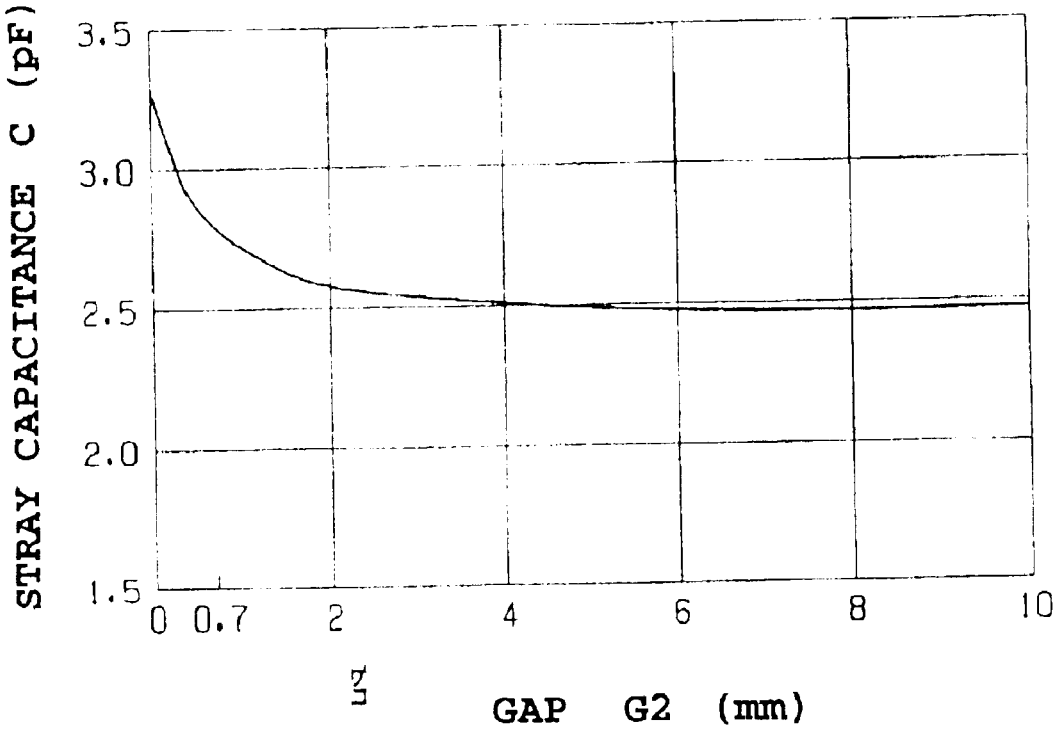
FIG. 7 is a graph showing the relationship between the gap G2 of the wire-wound coil shown in FIG. 1 and the stray capacitance C.

In the common-mode choke coil 31, the stray capacitance C is decreased by increasing the lengths of the gaps G1 and G2. However, the sizes of the components also increase as the gaps G1 and G2 increase. Accordingly, it is necessary to determine the ranges for the lengths of the gaps G1 and G2 that can efficiently reduce the stray capacitance C. FIG. 6 is a graph showing the relationship between the gap G1 and the stray capacitance C, and FIG. 7 is a graph showing the relationship between the gap G2 and the stray capacitance C. These graphs show that the lengths of the gaps G1 and G2 that can efficiently reduce the stray capacitance C range from about 0.3 mm to about 1.5 mm, and about 0.7 mm to about 4.0 mm, respectively. More preferably, the gap G1 ranges from about 0.5 mm to about 1.0 mm and the gap G2 ranges from about 1.0 mm to about 2.0 mm. The lower limits of the lengths of the gaps G1 and G2 are determined in consideration of the electrical characteristics of the common-mode choke coil 31. In contrast, the upper limits of the lengths of the gaps G1 and G2 are determined in consideration of, for example, size reduction of the components and the increase in inductance (in a case in which the sizes of the components are fixed, the winding space increases as the gaps decrease, and therefore, the inductance can be increased).

As shown in FIG. 1, an angular substantially U-shaped fastening member 60 is fitted between the bobbins 32 and 42 so as to bring the abutting surfaces of the core members 50*a* and 50*b* into tight contact.

The core members 50*a* and 50*b* are preferably made of a Mn—Zn ferrite or a Ni—Zn ferrite. In particular, since the Mn—Zn ferrite has high magnetic permeability, even when the numbers of turns of the windings 37 and 47 are relatively small, a high inductance of about several tens of millihenries to about several hundreds of millihenries can be achieved. Incidentally, an inductance of several tens of about millihenries to about several hundreds of millihenries is necessary to reduce the noise voltage from the low-frequency band (several kilohertz).

The above-described components 32, 42, 50*a*, 50*b*, and 60 are fixed by a fixture (not shown), or are fixed by applying the required minimum amount of adhesive (not shown) between the bobbins 32 and 42 and the core members 50*a* and 50*b*. It is not preferable to use varnish for fixing because it causes a large stray capacitance C when it enters between the adjoining turns of the winding 37 (or 47).

In the common-mode choke coil having the above-described configuration, when a common-mode noise current flows through the windings 37 and 47, magnetic fluxes in the same direction are generated in the magnetic core 50 by the windings 37 and 47. The magnetic fluxes are consumed while circulating in the magnetic core 50.

In the common-mode choke coil 31, the gaps G2 are formed between the inner side surfaces 51*aa* and 51*bb* of the arm portions 51*a* and 51*b* of the core members 50*a* and 50*b* and the outer major surfaces 34*a*, 35*a*, 44*a*, and 45*a* of the flange portions 34, 35, 44, and 45 of the bobbins 32 and 42. Furthermore, the gaps GI are formed between the outer peripheral surfaces (including four surfaces, that is, the upper surface, the lower surface, the inner surface, and the outer surface) 52*a* and 52*ba* of the leg portions 52*a* and 52*b* of the core members 50*a* and 50*b*, and the inner walls of the holes 33*a* and 43*a* of the bobbins 32 and 42. Therefore, the influence of the magnetic core 50 on the stray capacitance C can be reduced. For example, the stray capacitance C of about 0.5 pF in the known single-layer common-mode choke coil could be reduced to about 0.3 pF by the single-layer common-mode choke coil of this preferred embodiment. That is, the stray capacitance could be reduced by approximately 40%. As a result, it is possible to achieve a common-mode choke coil that has a high noise-eliminating performance in the high-frequency region.

Incidentally, in a case in which preferred embodiments of the present invention was applied to a known sectional-winding common-mode choke coil, the stray capacitance of about 2.0 pF was reduced to about 1.8 pF, that is, it could be reduced by approximately 10%.

Since a common-mode choke coil generally has a small normal-mode leakage inductance component, it can also eliminate normal-mode noise. However, when not only common-mode noise, but also high normal-mode noise flow through a signal (power-supply) line, they must be eliminated by using both a common-mode choke coil and a normal-mode choke coil. In the case of a common-mode choke coil having a relatively large normal-mode leakage inductance component, leakage flux may adversely affect peripheral circuits, and therefore, it is necessary to provide a magnetic shielding member around the outside of the common-mode choke coil.

Figure 8:
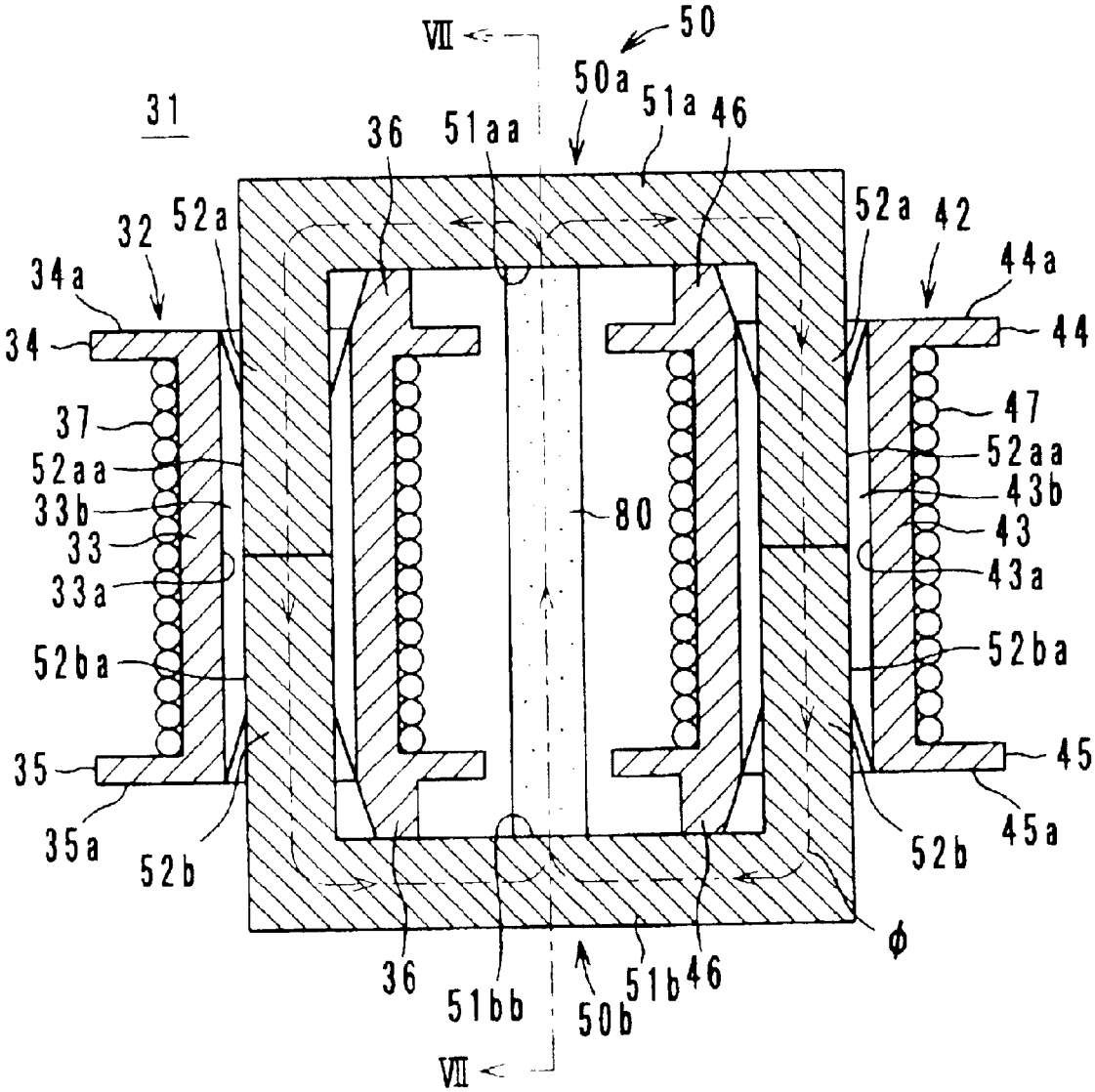
FIG. 8 is a horizontal sectional view of a modification of the wire-wound coil shown in FIG. 1.
Figure 9:
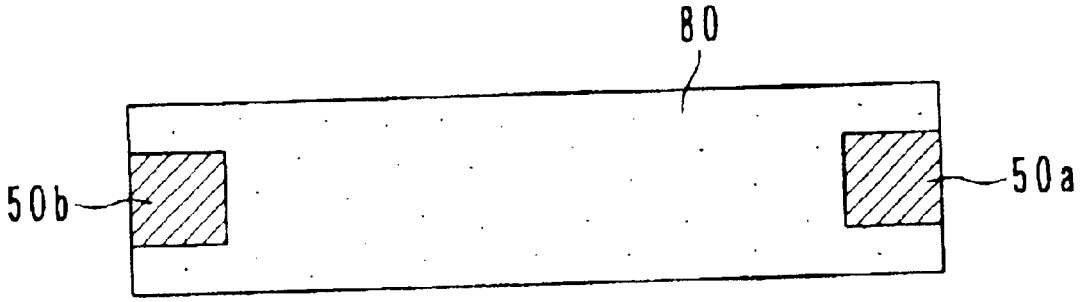
FIG. 9 is a vertical sectional view taken along line VII—VII in FIG. 8.

Accordingly, as shown in FIGS. 8 and 9, a magnetic-powder-containing insulating resin member 80 having a relative magnetic permeability of about 1 or more (for example, about 2 to about several tens) is disposed between the two adjoining bobbins 32 and 42 of the common-mode choke coil 31. The magnetic-powder-containing insulating resin member 80 is made, for example, by kneading a Ni—Zn or Mn—Zn ferrite of approximately 80 wt % to approximately 90 wt % and a nylon or polyphenylene sulfide resin. Since the magnetic-powder-containing insulating resin member 80 is easy to machine and is insulative, there is no need to put an insulating spacer between the magnetic-powder-containing insulating resin member 80 and the core members 50*a* and 50*b*.

By providing the magnetic-powder-containing insulating resin member 80, the effective magnetic permeability of the normal-mode magnetic circuit is increased, and magnetic flux Φ is concentrated in the portions of the magnetic circuit having a high effective magnetic permeability (the magnetic-powder-containing insulating resin member 80 and the core members 50*a* and 50*b*). For this reason, the normal-mode inductance component increases. Consequently, the common-mode choke coil 31 can reduce high normal mode noise, and the adverse influence of the leakage magnetic flux on the peripheral circuits can be reduced.

The normal-mode inductance component is determined, for example, by the contact area between the core members 50*a* and 50*b*, and the magnetic-powder-containing insulating resin member 80, the gap therebetween, and the relative magnetic permeability of the magnetic-powder-containing insulating resin member 80. In the common-mode choke coil 31, the core members 50*a* and 50*b* become more prone to saturation by increasing the normal-mode inductance component, and therefore, the limit to which the normal-mode inductance component can be increased is determined by the characteristics (for example, saturation characteristic and relative magnetic permeability) of the core members 50*a* and 50*b* to be used, and the current flowing through the common-mode choke coil 31. That is, it is necessary to increase the normal-mode inductance component using the magnetic-powder-containing insulating resin member 80 within the operation guarantee range of the common-mode choke coil 31 so that the core members 50*a* and 50*b* will not be saturated.

By disposing the magnetic-powder-containing insulating resin member 80 between the two bobbins 32 and 42, the insulation distance between the windings 37 and 47 can be increased, and the space in the common-mode choke coil 31 can be effectively utilized, thus preventing an increase in size.

Figure 10:
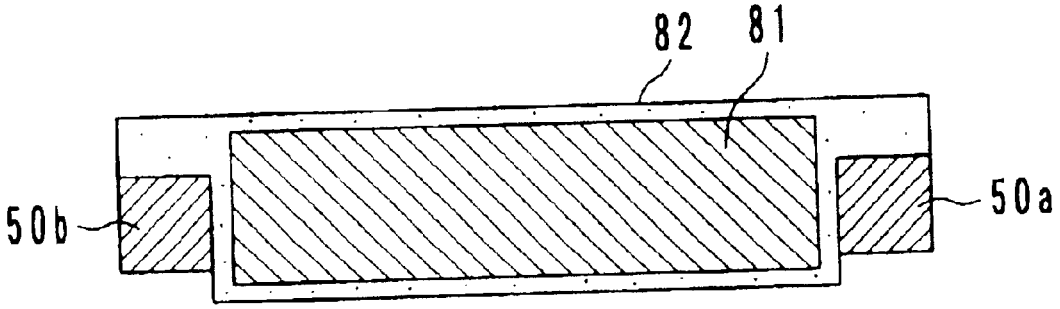
FIG. 10 is a vertical sectional view of a modification of the wire-wound coil shown in FIG. 9.

The magnetic-powder-containing insulating member 80 may be replaced with a ferrite member 81 having a surface that is covered with insulating resin 82, as shown in FIG. 10. The ferrite member (Ni-Zn or Mn-Zn ferrite) 81 also provides advantages similar to those of the magnetic-powder-containing insulating resin member 80. The magnetic-powder-containing insulating resin member 80 or the ferrite member 81 may have an arbitrarily shape, for example, it may be substantially H-shaped, as shown in FIG. 9, substantially T-shaped, as shown in FIG. 10, or substantially rectangular.

Figure 11:
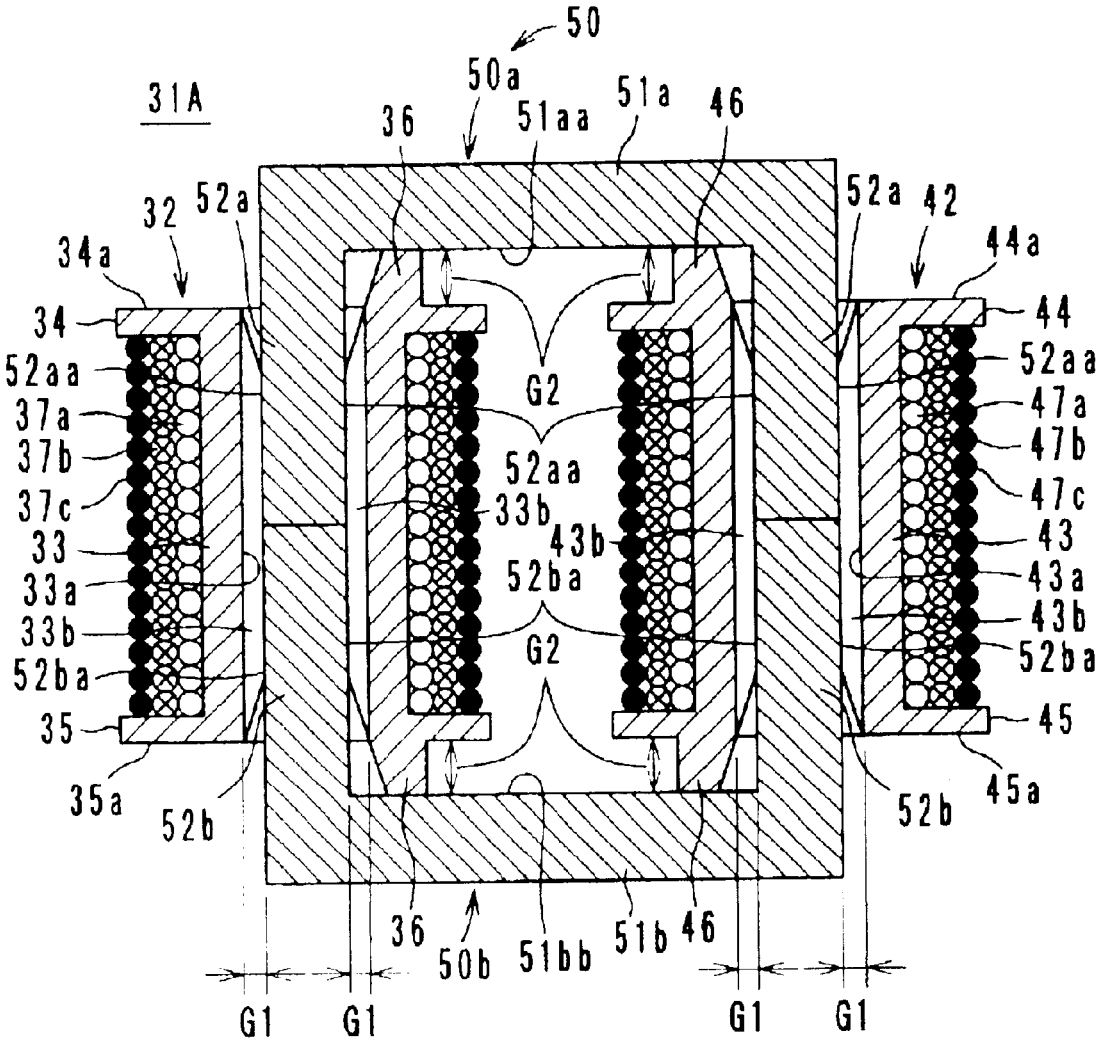
FIG. 11 is a horizontal sectional view of a wire-wound coil according to another preferred embodiment of the present invention.
Figure 12:
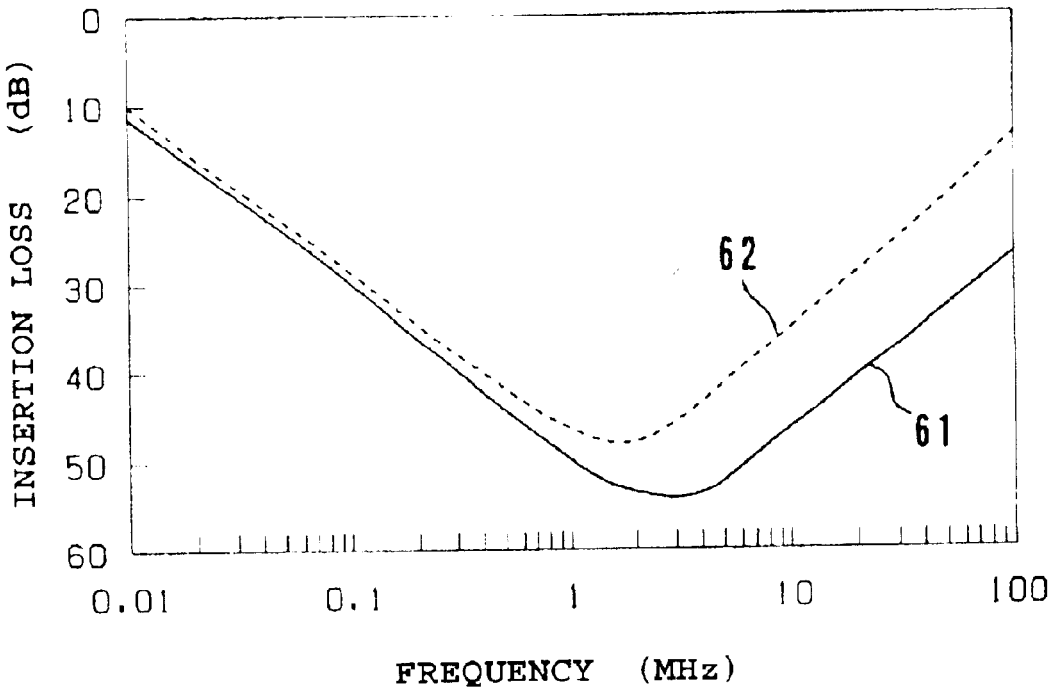
FIG. 12 is a graph showing the insertion loss versus frequency characteristic of the wire-wound coil shown in FIG. 11.

Although the single-layer winding structure is most effective in reducing the stray capacitance C, it is difficult to obtain a large inductance and to sufficiently reduce the common-mode noise in the low-frequency region. Accordingly, a common-mode choke coil 31A shown in FIG. 11 adopts a single-layer multiple winding structure in which single-layer windings 37*a*, 37*b*, and 37*c*, and single-layer windings 47*a*, 47*b*, and 47*c* are sequentially stacked around substantially cylindrical body portions 33 and 43 of bobbins 32 and 42. FIG. 12 is a graph showing the insertion loss versus frequency characteristic of the single-layer multiple winding common-mode choke coil 31A (see solid line 61). For comparison, FIG. 12 also shows the insertion loss versus frequency characteristic of a known single-layer multiple winding common-mode choke coil (see dotted line 62).

Figure 13:
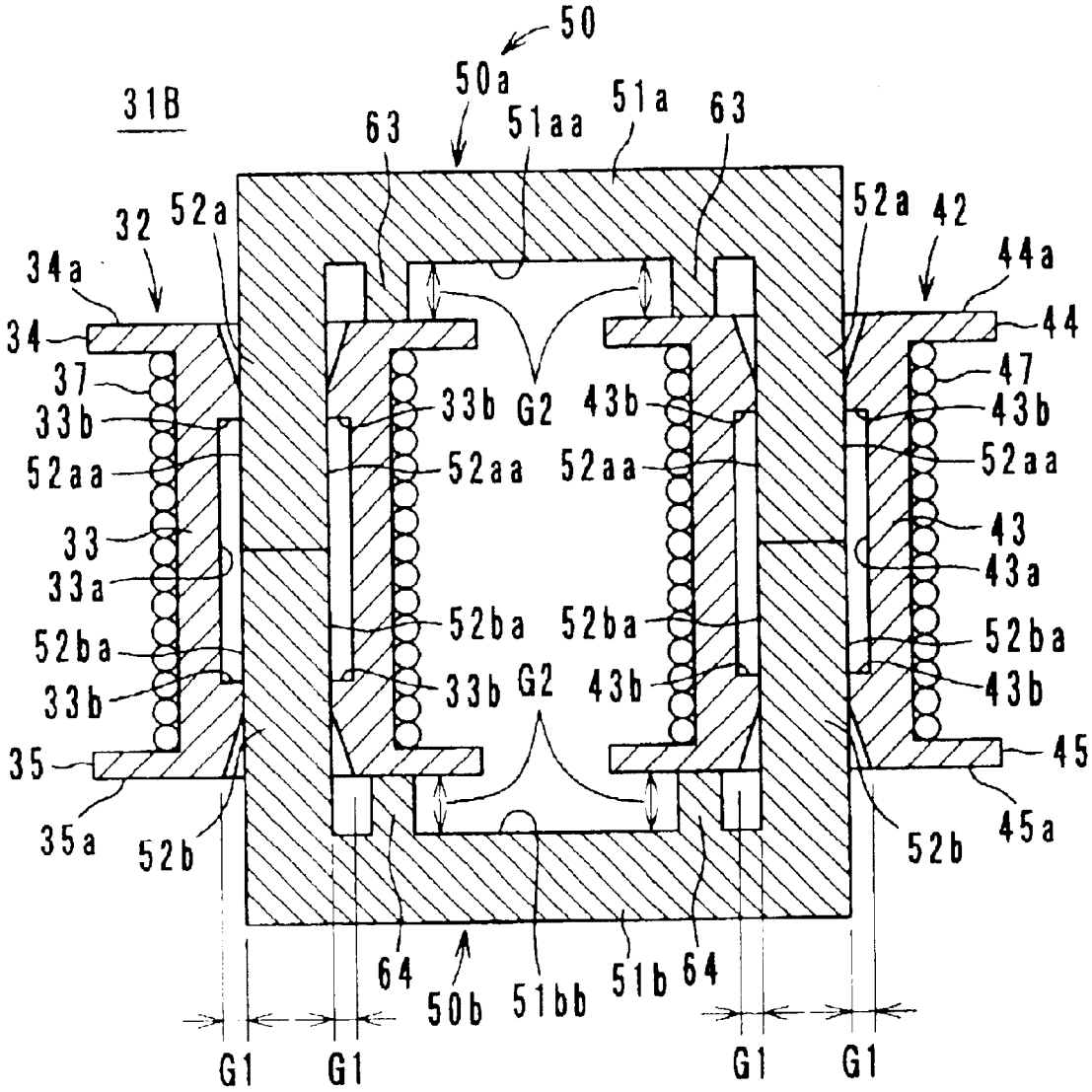
FIG. 13 is a horizontal sectional view of a wire-wound coil according to a further preferred embodiment of the present invention.

In a common-mode choke coil 31B shown in FIG. 13, short rail-shaped ribs 33*b* and 43*b* are disposed at the apertures at both ends of holes 33*a* and 43*a* of bobbins 32 and 42. The rail-shaped ribs 33*b* and 43*b* are disposed on four inner walls of the corresponding holes 33*a* and 43*a*, and are tapered so that leg portions 52*a* and 52*b* of core members 50*a* and 50*b* can be easily inserted into the holes 33*a* and 43*a*. By the abutment of the rail-shaped ribs 33*b* and 43*b* and outer peripheral surfaces (four faces) 52*aa* and 52*ba* of the leg portions 52*a* and 52*b*, gaps G1 of a predetermined length are formed between the outer peripheral surface 52*aa* and 52*ba* of the leg portions 52*a* and 52*b*, and the inner walls of the holes 33*a* and 43*a*.

A pair of convex spacers 63 and a pair of convex spacers 64 are disposed on inner side surfaces 51*aa* and 51*bb* of arm portions 51*a* and 51*b* in the core members 50*a* and 50*b*, respectively. When the core members 50*a* and 50*b* are assembled with the bobbins 32 and 42, the leading ends of the convex spacers 63 and 64 abut outer major surfaces 34*a*, 35*a*, 44*a*, and 45*a* of flange portions 34, 35, 44, and 45. Therefore, gaps G2 of a predetermined length are formed between the inner side surfaces 51*aa* and 51*bb* of the arm portions 51*a* and 51*b*, and the outer major surfaces 34*a*, 35*a*, 44*a*, and 45*a* of the flange portions 34, 35, 44, and 45. The common-mode choke coil 31B provides advantages similar to those in the above-described common-mode choke coil 31.

Figure 14:
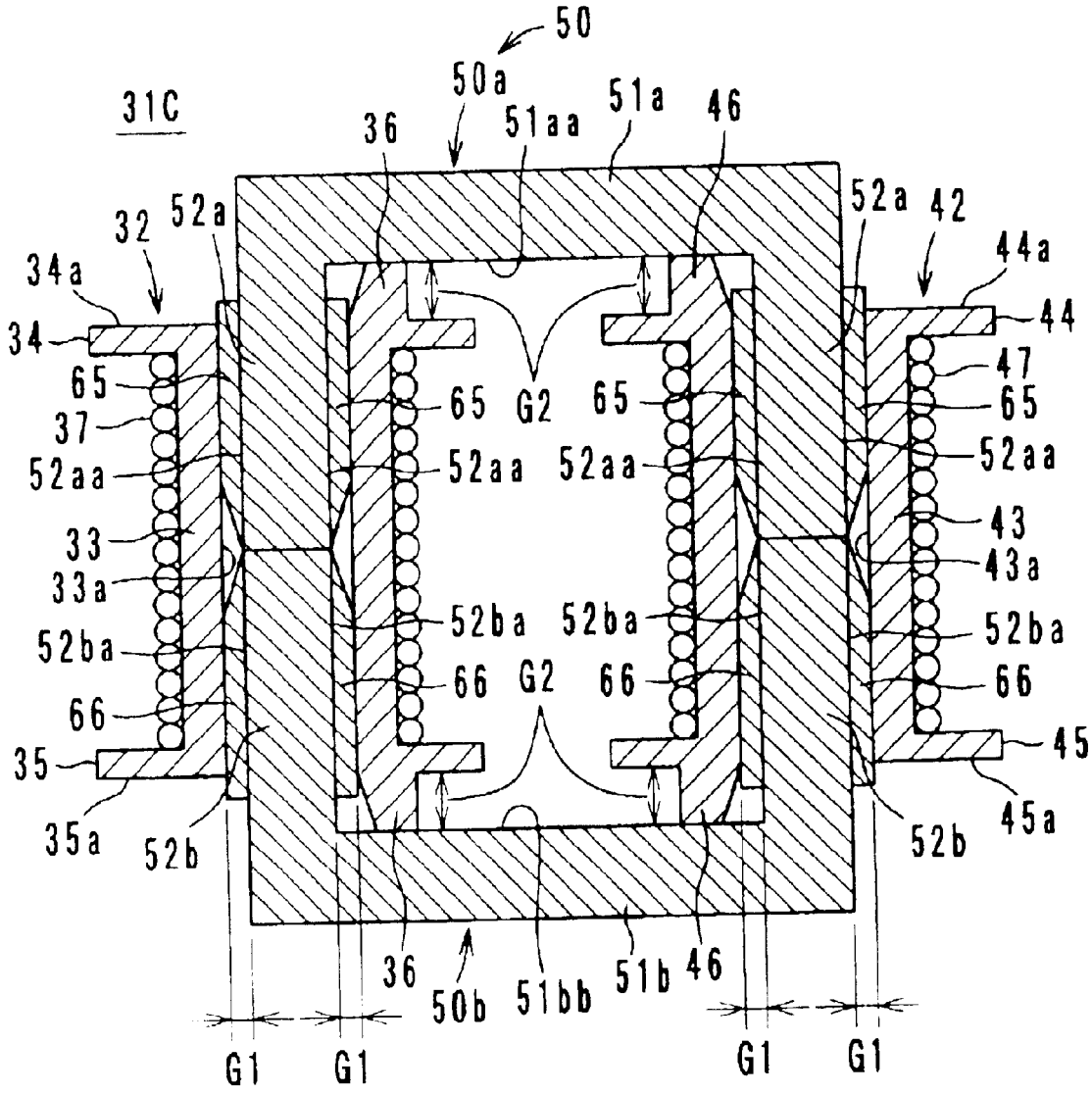
FIG. 14 is a horizontal sectional view of a wire-wound coil according to a still further preferred embodiment of the present invention.
Figure 15:
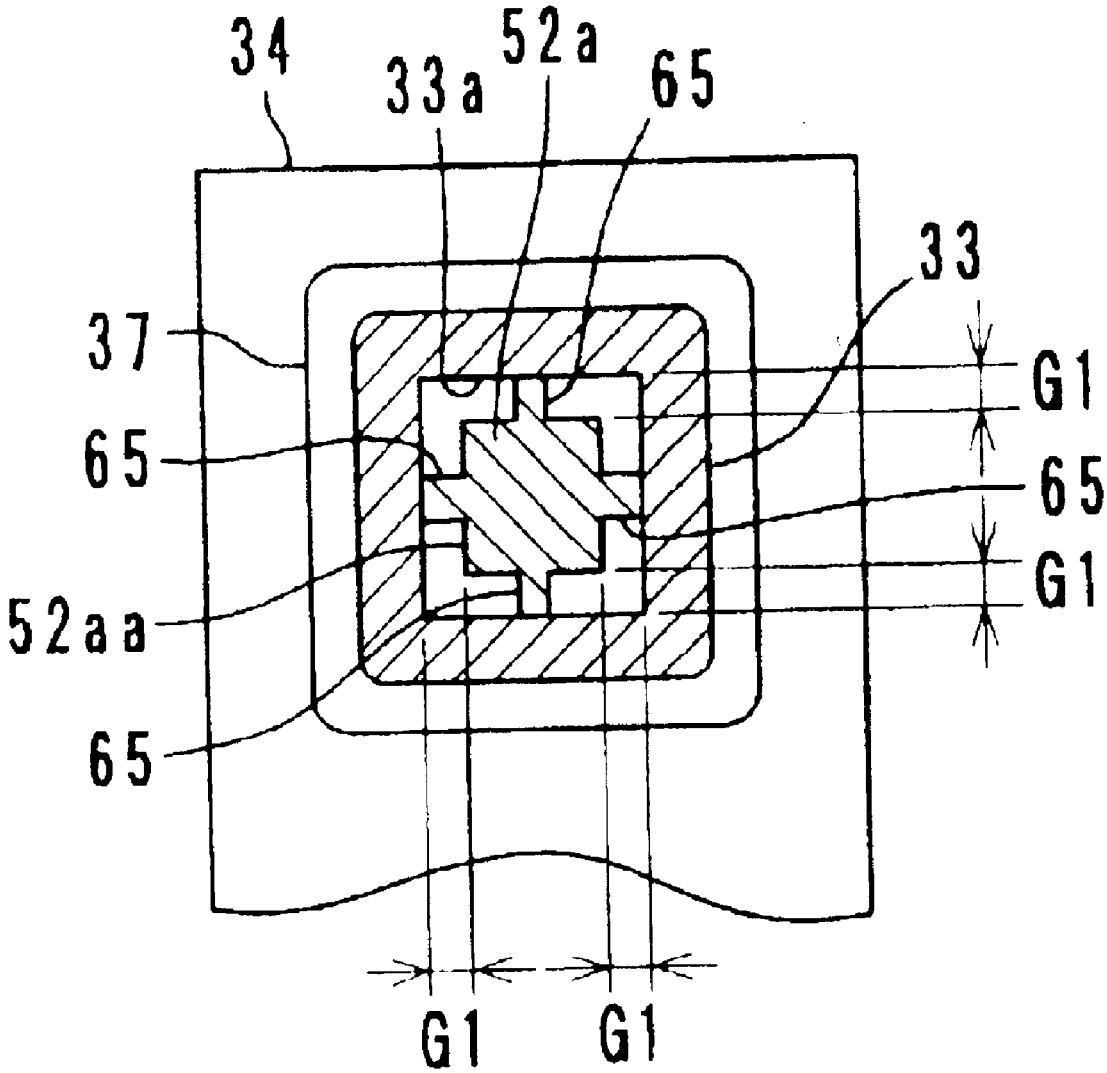
FIG. 15 is a partial vertical sectional view of the wire-wound coil shown in FIG. 14.

In a common-mode choke coil 31C shown in FIGS. 14 and 15, rail-shaped ribs 65 and 66 are disposed on outer peripheral surfaces (four surfaces) 52*aa* and 52*ba* of leg portions 52*a* and 52*b* in core members 50*a* and 50*b*, respectively. The leading ends of the rail-shaped ribs 65 and 66 are tapered so that the leg portions 52*a* and 52*b* of the core members 50*a* and 50*b* can be easily inserted into holes 33*a* and 43*a*. Gaps G1 of a predetermined length are formed between the outer peripheral surfaces 52*aa* and 52*ba* of the leg portions 52*a* and 52*b*, and the inner walls of the holes 33*a* and 43*a* by the rail-shaped ribs 65 and 66. The common-mode choke coil 31C provides advantages similar to those of the above-described common-mode choke coil 31.

Figure 16:
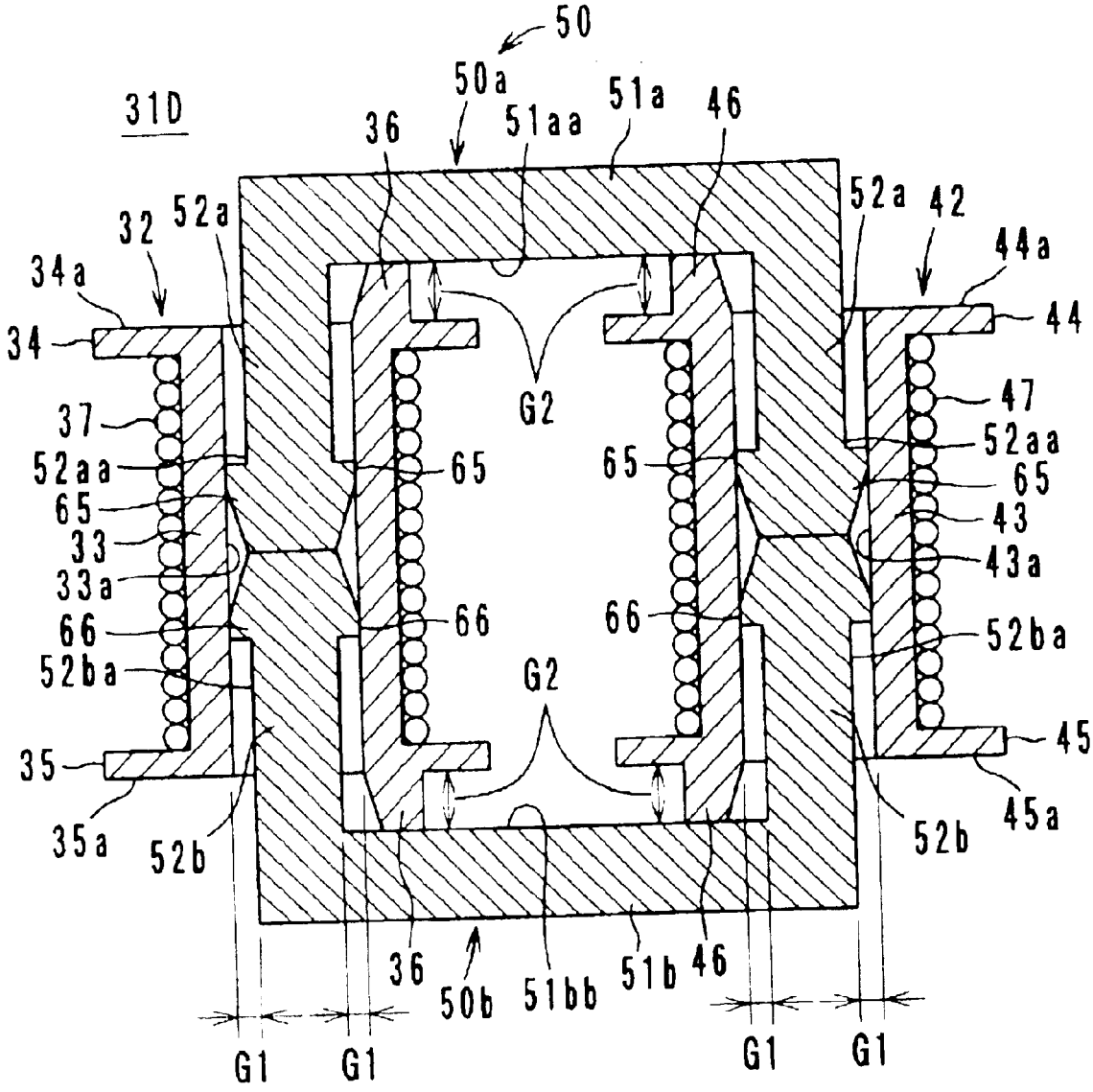
FIG. 16 is a horizontal sectional view of a wire-wound coil according to a still further preferred embodiment of the present invention.

In a common-mode choke coil 31D shown in FIG. 16, short rail-shaped ribs 65 and 66 are disposed on outer peripheral surfaces (four surfaces) 52*aa* and 52*ba* at the leading ends of leg portions 52*a* and 52*b* of core members 50*a* and 50*b*, respectively. The rail-shaped ribs 65 and 66 are tapered so that the leg portions 52*a* and 52*b* of the core members 50*a* and 50*b* can be easily inserted into holes 33*a* and 43*a*. Gaps G1 of a predetermined length are formed between the outer peripheral surfaces 52*aa* and 52*ba* of the leg portions 52*a* and 52*b*, and inner walls of the holes 33*a* and 43*a* by the rail-shaped ribs 65 and 66. The common-mode choke coil 31D provides advantages similar to those of the above-described common-mode choke coil 31.

Figure 17:
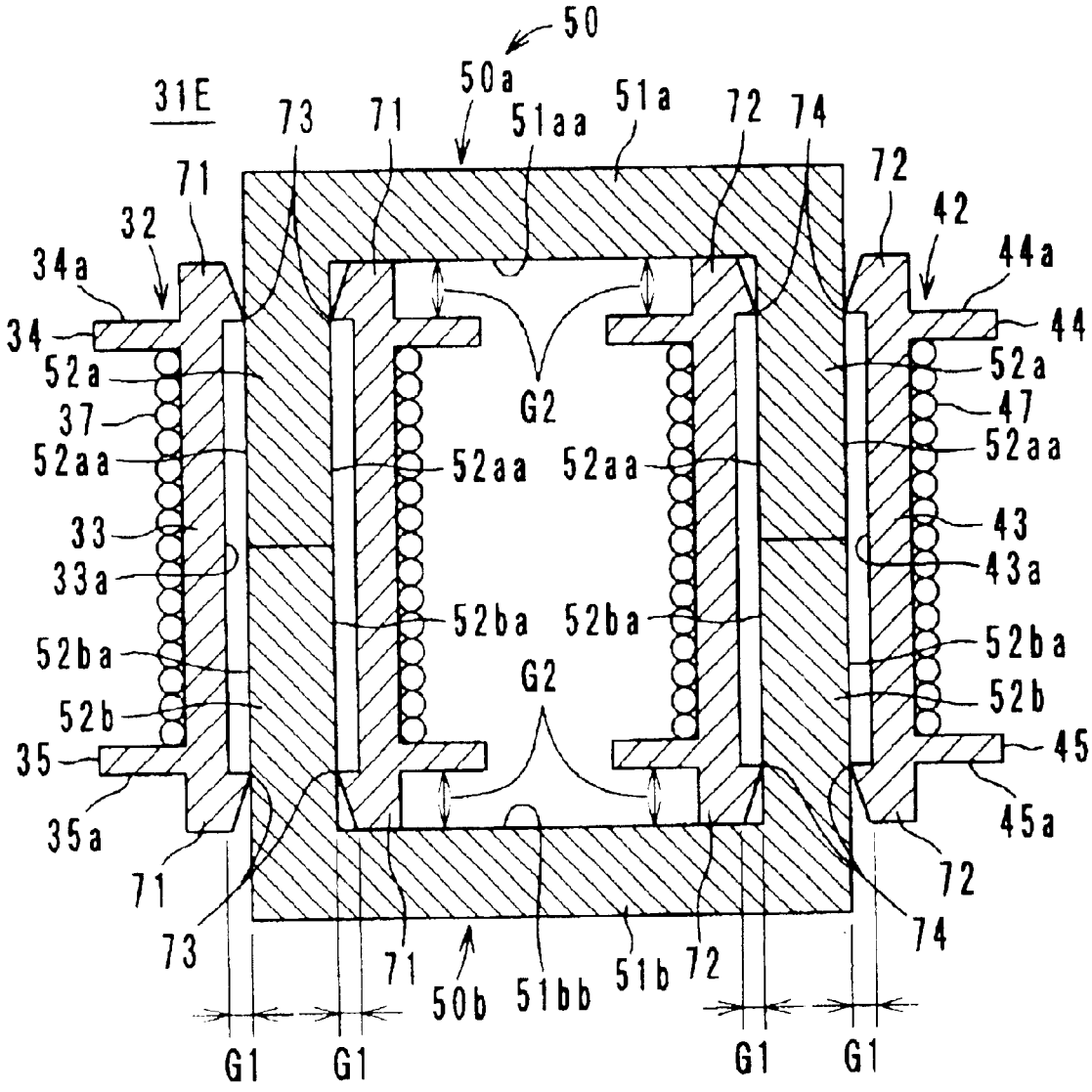
FIG. 17 is a horizontal sectional view of a wire-wound coil according to a still further preferred embodiment of the present invention.

In a common-mode choke coil 31E shown in FIG. 17, four convex spacers 71 and four convex spacers 72 are disposed at intervals of approximately 90° at the apertures at both ends of holes 33*a* and 43*a* of bobbins 32 and 42, respectively. The surfaces of the convex spacers 71 and 72 facing the holes 33*a* and 43*a* of the substantially cylindrical body portions 33 and 43 are tapered so that leg portions 52*a* and 52*b* of core members 50*a* and 50*b* can be easily inserted into the holes 33*a* and 43*a*. First end portions 73 and 74 of the tapered surfaces are shaped like projections that protrude from the four inner walls of the holes 33*a* and 43*a*. Gaps G1 of a predetermined length are formed between outer peripheral surfaces 52*aa* and 52*ba* of the leg portions 52*a* and 52*b*, and the inner walls of the holes 33*a* and 43*a* by the projections 73 and 74.

When the core members 50*a* and 50*b* are assembled with the bobbins 32 and 42, the leading ends of the convex spacers 71 and 72 abut the inner side surfaces 51*aa* and 51*bb* of the arm portions 51*a* and 51*b*. Therefore, gaps G2 of a predetermined length are formed between the inner side surfaces 51*aa* and 51*bb* of the arm portions 51*a* and 51*b*, and outer major surfaces 34*a*, 35*a*, 44*a*, and 45*a* of flange portions 34, 35, 44, and 45 by the convex spacers 71 and 72. The common-mode choke coil 31E provides advantages similar to those of the above-described common-mode choke coil 31.

Furthermore, the convex spacers 71 and 72 are arranged inside the inner-diameter areas of windings 37 and 47 so that they do not face the windings 37 and 47 with the flange portions 34, 35, 44, and 45 therebetween. This makes it possible to more efficiently reduce the stray capacitance.

Figure 18:
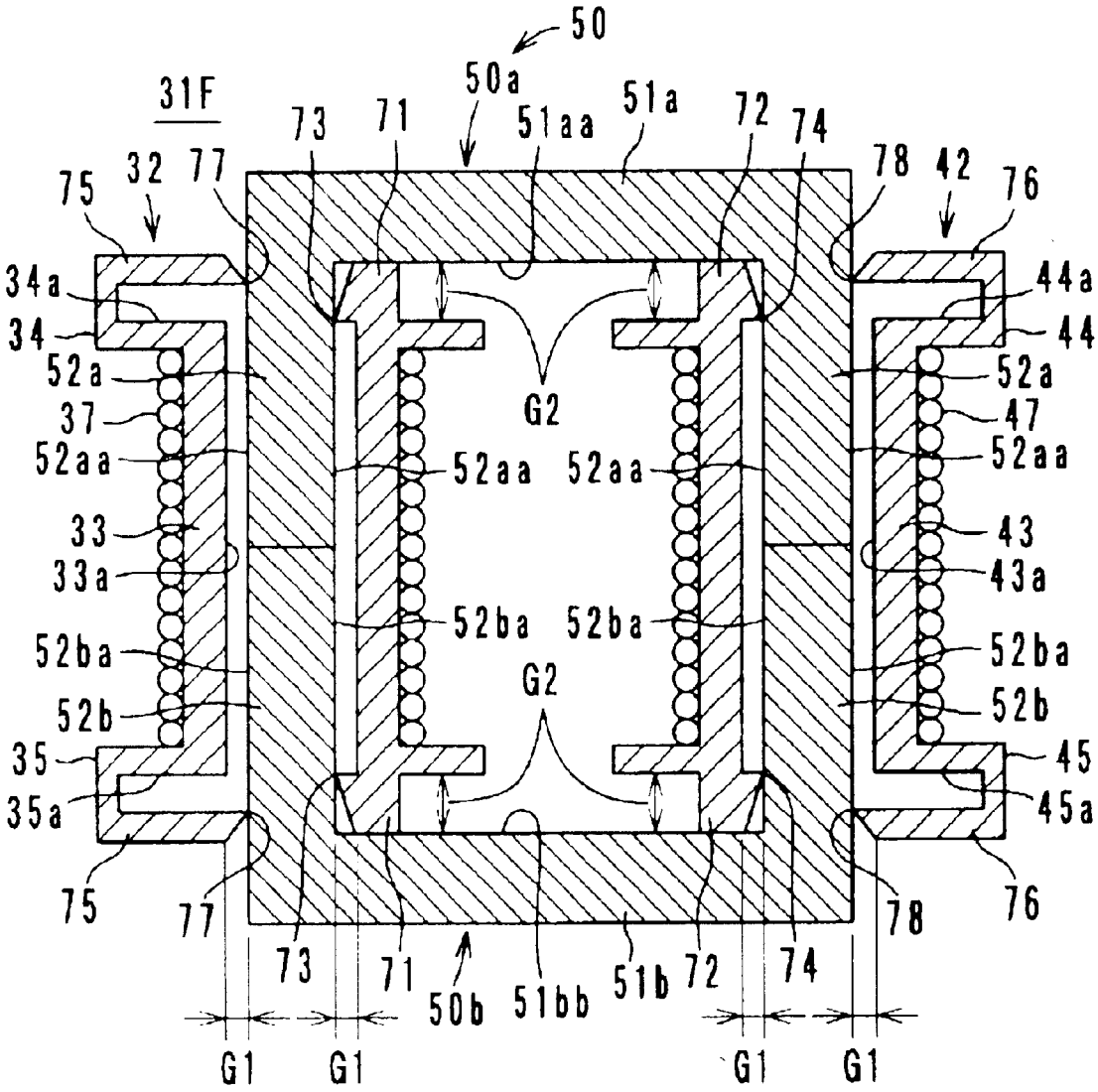
FIG. 18 is a is a horizontal sectional view of a wire-wound coil according to a still further preferred embodiment of the present invention.

In a common-mode choke coil 31F shown in FIG. 18, some of the convex spacers 71 and 72 in the common-mode choke coil 31E show in FIG. 17 are replaced with substantially L-shaped convex spacers 75 and 76. Leading end surfaces of the convex spacers 75 and 76 facing holes 33*a* and 43*a* of substantially cylindrical body portions 33 and 43 are tapered so that leg portions 52*a* and 52*b* of core members 50*a* and 50*b* can be easily inserted into the holes 33*a* and 43*a*. Furthermore, first end portions 77 and 78 of the tapered surfaces are shaped like projections that protrude from the inner walls of the holes 33*a* and 43*a*. Gaps G1 of a predetermined length are formed between outer peripheral surfaces 52*aa* and 52*ba* of the leg portions 52*a* and 52*b*, and the inner walls of the holes 33*a* and 43*a* by the projections 77 and 78 and the projections 73 and 74.

The convex spacers 71 and 72 are disposed inside the inner-diameter areas of windings 37 and 47 so that they do not face the windings 37 and 47 with flange portions 34, 35, 44, and 45 therebetween. The convex spacers 75 and 76 are joined to the flange portions 34, 35, 44, and 45 outside the outer-diameter areas of the windings 37 and 47, and face the windings 37 and 47 with the flange portions 34, 35, 44, and 45 and the gaps therebetween.

The present invention is not limited to the above described preferred embodiments, and instead, the present invention covers various modifications and equivalent arrangements included within the spirit and scope of the appended claims. For example, a one-piece core shaped like a square or a one-piece core shaped like two joined squares may be used as the magnetic core, and a toothed bobbin divided into two or more pieces may be used as the bobbin. While the two-line type including two windings is preferably used in the above-described preferred embodiments, another type using three or more windings may be used.

The present invention may be applied not only to the common-mode choke coil, but also to an inductor having a structure in which one of the two bobbins 32 and 42 shown in FIG. 1 is removed. The present invention is also applicable to other coils such as a normal-mode choke coil and a transformer. The present invention is also applicable to a so-called hybrid choke coil in which common-mode noise (normal-mode noise) is eliminated by the core, and normal-mode noise (common-mode noise) is eliminated by the bobbin. The present invention is advantageous for not only the common-mode noise, but also for the normal-mode noise.

Figure 19:
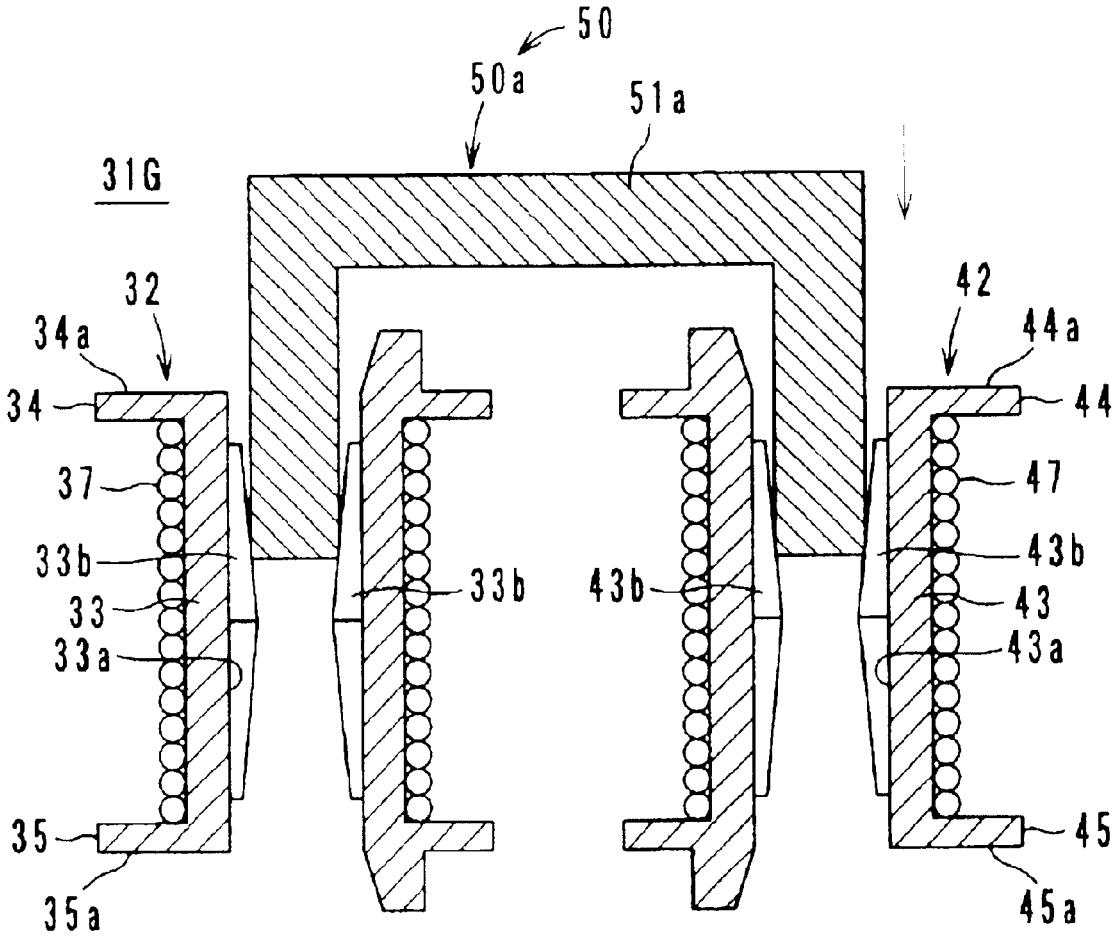
FIG. 19 is a horizontal sectional view of a wire-wound coil according to a still further preferred embodiment of the present invention.

The transverse cross-section of the rail-shaped projections and the convex spacers does not always need to be substantially rectangular. Instead, the transverse cross-section may be substantially semicircular, substantially trapezoidal, or substantially triangular, or other suitable shape. For example, a common-mode choke coil 31G shown in FIG. 19 has rail-shaped projections 33*b* and 43*b* that are substantially triangular in transverse cross-section and are tapered from both apertures of holes 33*a* and 43*a*. Leg portions 52*a* and 52*b* of core members 50*a* and 50*b* are inserted and positioned in the holes 33*a* and 43*a* while depressing the apexes of the rail-shaped projections 33*b* and 43*b*.

Figure 20:
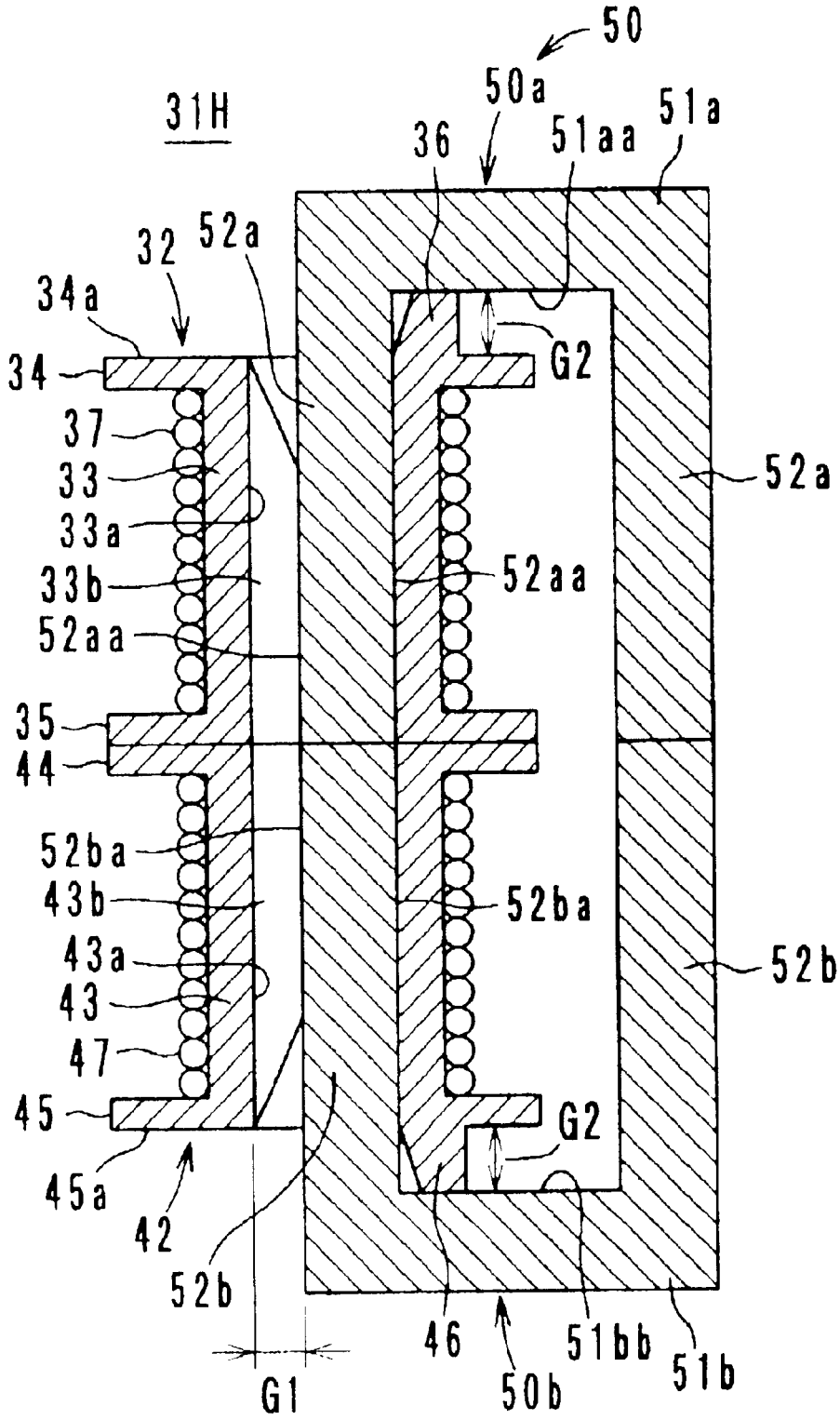
FIG. 20 is a horizontal sectional view of a wire-wound coil according to a still further preferred embodiment of the present invention.
Figure 21:
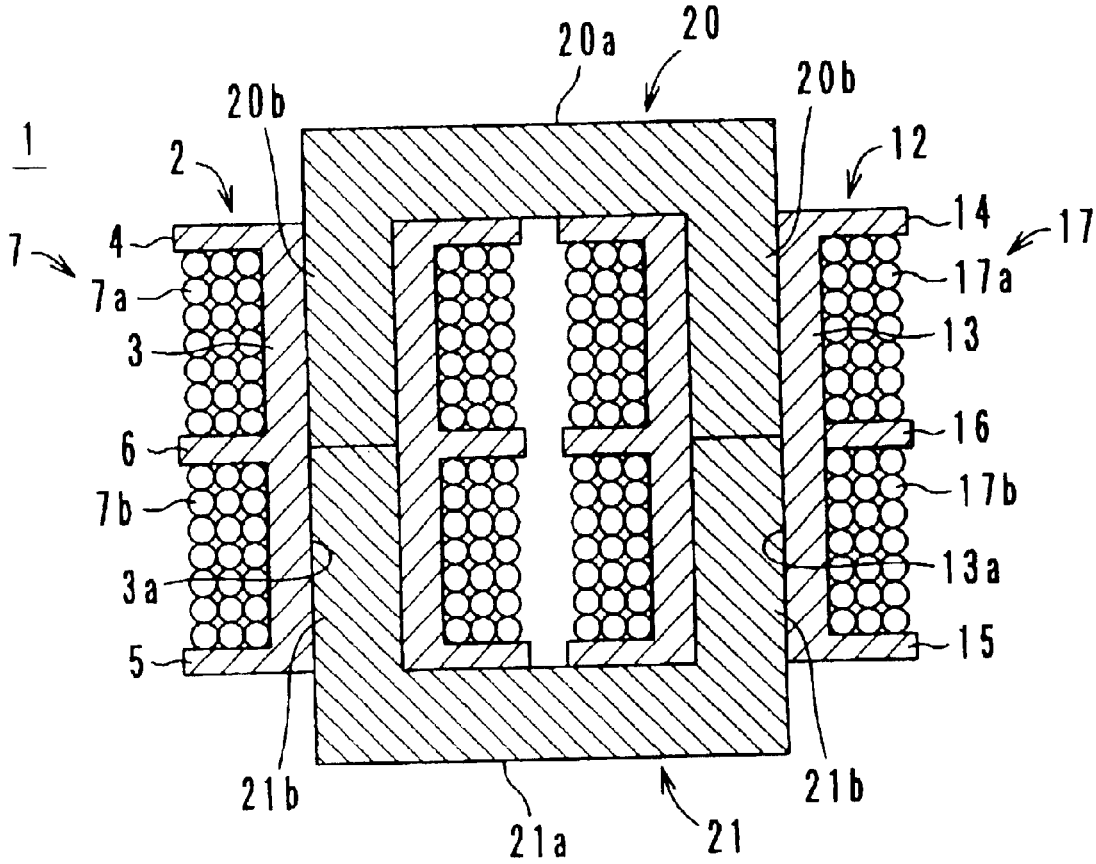
Fig. 21 PRIOR ART
FIG. 21 is a horizontal sectional view of a known wire-wound coil.

A common-mode choke coil 31H may be adopted in which bobbins 32 and 42 are connected such that their axes are aligned with each other, and leg portions 52*a* and 52*b* at one side of core members 50*a* and 50*b* extend in connected holes 33*a* and 43*a*, as shown in FIG. 20. In this case, the stray capacitance can be reduced even when the inner side surfaces of the leg portions 52*a* and 52*b* of the core members 50*a* and 50*b* are in contact with the inner walls of the holes 33*a* and 43*a* of the bobbins 32 and 42, that is, even when gaps G1 of a predetermined length are formed between the outer, upper, and lower side surfaces of the leg portions 52*a* and 52*b* and the inner walls of the holes 33*a* and 43*a*.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A wire-wound coil comprising:

a bobbin having a substantially cylindrical body portion and a flange portion disposed on said substantially cylindrical body portion;

a winding wound on said substantially cylindrical body portion in one of a single-layer winding configuration and a single-layer multiple winding configuration; and a magnetic core having an arm portion and a leg portion, said leg portion extending in a hole disposed in said substantially cylindrical body portion so as to define a closed magnetic circuit;

wherein a substantially constant gap is formed by a rib between an inner peripheral surface of said hole of said substantially cylindrical body portion and an outer peripheral surface of said leg portion of said magnetic core.

2. A wire-wound coil according to claim 1, wherein the rib is a rail-shaped rib disposed on at least one of said inner peripheral surface of said hole of said substantially cylindrical body portion and said outer peripheral surface of said leg portion of said magnetic core.

3. A wire-wound coil according to claim 1, wherein a plurality of said bobbins are provided, and said substantially constant gap is formed between said inner peripheral surface of said hole of said substantially cylindrical body portion of each of said bobbins and said outer peripheral surface of said leg portion of said magnetic core.

4. A wire-wound coil according to claim 3, wherein an insulating resin member including magnetic powder is provided between two adjacent bobbins of said plurality of bobbins.

5. A wire-wound coil according to claim 3, wherein a ferrite member having a surface that is covered with insulating resin is provided between two adjacent bobbins of said plurality of bobbins.

6. A wire-wound coil according to claim 1, wherein said substantially constant gap is within the range of about 0.3 mm to about 1.5 mm.

7. A wire-wound coil comprising:

a bobbin having a substantially cylindrical body portion and a flange portion disposed on said substantially cylindrical body portion;

a winding wound on said substantially cylindrical body portion in one of a single-layer winding configuration and a single-layer multiple winding configuration;

a convex spacer disposed on at least one of said flange portion and said arm portion of said magnetic core facing said flange portion; and a magnetic core having an arm portion and a leg portion, said leg portion extending in a hole formed in said substantially cylindrical body portion so as to define a closed magnetic circuit;

wherein a gap is formed between said flange portion and said arm portion of said magnetic core.

8. A wire-wound coil according to claim 7, wherein said gap is defined between said flange portion and said arm portion of said magnetic core by said convex spacer.

9. A wire-wound coil according to claim 7, wherein a plurality of said bobbins are provided, and said gap is defined between said flange portion of each of said bobbins and said arm portion of said magnetic core.

10. A wire-wound coil according to claim 9, wherein an insulating resin member including magnetic powder is provided between two adjacent bobbins of said plurality of bobbins.

11. A wire-wound coil according to claim 9, wherein a ferrite member having a surface that is covered with insulating resin is provided between two adjacent bobbins of said plurality of bobbins.

12. A wire-wound coil according to claim 7, wherein said gap is within the range of about 0.7 mm to about 4.0 mm.

13. A wire-wound coil comprising:

a bobbin having a substantially cylindrical body portion and a flange portion disposed on said substantially cylindrical body portion;

a winding wound on said substantially cylindrical body portion in one of a single-layer winding configuration and a single-layer multiple winding configuration; and a magnetic core having an arm portion and a leg portion, said leg portion extending in a hole formed in said substantially cylindrical body portion so as to define a closed magnetic circuit; wherein a first substantially constant gap is formed by a rib between an inner peripheral surface of said hole of said substantially cylindrical body portion and an outer peripheral surface of said leg portion of said magnetic core; and a second gap is formed between said flange portion and said arm portion of said magnetic core.

14. A wire-wound coil according to claim 13, wherein a plurality of said bobbins are provided, said first substantially constant gap is formed between said inner peripheral surface of said hole formed in said substantially cylindrical body portion of each of said plurality of bobbins and said outer peripheral surface of said leg portion of said magnetic core extending in said hole of said substantially cylindrical body portion, and said second gap is formed between said flange portion of each of said substantially bobbins and said arm portion of said magnetic core.

15. A wire-wound coil according to claim 14, wherein an insulating resin member including magnetic powder is provided between two adjacent bobbins of said plurality of bobbins.

16. A wire-wound coil according to claim 14, wherein a ferrite member having a surface that is covered with insulating resin is provided between two adjacent bobbins of said plurality of bobbins.

17. A wire-wound coil according to claim 13, further comprising:

a convex spacer disposed on at least one of said flange portion and said arm portion of said magnetic core facing said flange portion; wherein the rib is rail-shaped and is disposed on at least one of said inner peripheral surface of said hole of said substantially cylindrical body portion and said outer peripheral surface of said leg portion of said magnetic core.

18. A wire-wound coil according to claim 17, wherein said first gap is defined between all inner peripheral surfaces of said hole of said substantially cylindrical body portion and all outer peripheral surfaces of said leg portion of said magnetic core by said rail-shaped rib, and said second gap is defined between said flange portion and said arm portion of said magnetic core facing said flange portion by said convex spacer.

19. A wire-wound coil according to claim 13, wherein said first substantially constant gap is within the range of about 0.3 mm to about 1.5 mm.

20. A wire-wound coil according to claim 13, wherein said second gap is within the range of about 0.7 mm to about 4.0 mm.

21. A wire-wound coil comprising:

a bobbin having a substantially cylindrical body portion and a flange portion disposed on said substantially cylindrical body portion;

a winding wound on said substantially cylindrical body portion in one of a single-layer winding configuration and a single-layer multiple winding configuration; and a magnetic core having an arm portion and a leg portion, said leg portion extending in a hole disposed in said substantially cylindrical body portion so as to define a closed magnetic circuit; wherein a cross-section of the magnetic core is quadrangular; and a gap is formed between each side of the magnetic core and an inner peripheral surface of said hole of said substantially cylindrical body portion.

* * * * *